US006546854B2

(12) United States Patent
Metzger et al.

(10) Patent No.: US 6,546,854 B2
(45) Date of Patent: Apr. 15, 2003

(54) PROCESS FOR OPERATING A PRESS ARRANGEMENT

(75) Inventors: Kurt Metzger, Goeppingen (DE); Burkhard Schumann, Ottenbach (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 13 days.

(21) Appl. No.: 09/875,269

(22) Filed: Jun. 7, 2001

(65) Prior Publication Data

US 2002/0017205 A1 Feb. 14, 2002

(30) Foreign Application Priority Data

Jun. 7, 2000 (DE) ..... 100 28 148

(51) Int. Cl.[7] ..... B30B 15/30
(52) U.S. Cl. ..... 100/35; 100/45; 100/48

(58) Field of Search ..... 100/35, 45, 48, 100/53, 207, 93 P, 269 R; 72/419, 405.1, 405.9; 83/13, 35

(56) References Cited

U.S. PATENT DOCUMENTS 4,356,763 A * 11/1982 Hagstrom ..... 100/48
4,387,632 A * 6/1983 Heiberger ..... 100/45
4,654,569 A * 3/1987 Mizumoto et al. ..... 100/45 X
5,669,294 A 9/1997 Klemm et al. ..... 100/35

* cited by examiner

*Primary Examiner*—W. Donald Bray
(74) *Attorney, Agent, or Firm*—Crowell & Moring LLP

(57) ABSTRACT

Aa process for operating a press arrangement involves a press slide and at least one workpiece transport device that are electromechanically driven and electrically supplied by a supply and feedback device having at least one input and at least one output. In the event of a voltage drop at the input of the supply and feedback device, the current intensity at the input of the supply and feedback device is increased.

10 Claims, 1 Drawing Sheet

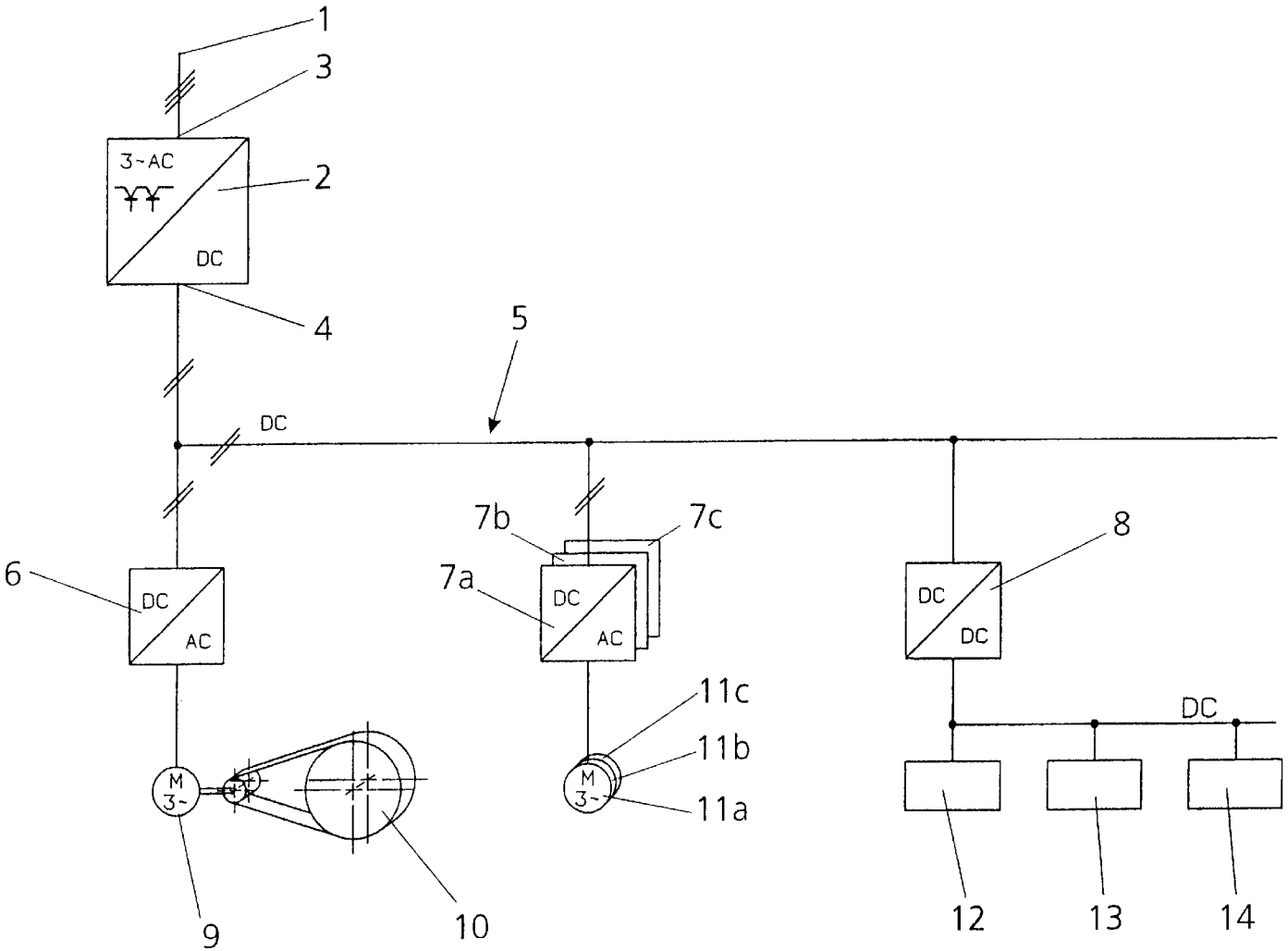
1
3
2
3~AC
DC
4
DC
5
DC
AC
6
M
3~
9
10
7a
7b
7c
DC
AC
11c
11b
11a
M
3~
8
DC
DC
DC
12
13
14

PROCESS FOR OPERATING A PRESS ARRANGEMENT

BACKGROUND OF THE INVENTION

This application claims the priority of German Patent Document 100 28 148.6, filed Jun. 7, 2000, the disclosure of which is expressly incorporated by reference herein.

The present invention relates to a process for operating a press arrangement in which a press slide and at least one workpiece transport device are electromechanically driven and are electrically supplied by means of a supply and feedback device having at least one input and at least one output.

DE 195 26 491 A1 discloses a process whereby, in the event of a power failure, all devices relevant to the movement of the workpiece transport devices are supplied with voltage from an intermediate circuit. As a result, at least the workpiece transport devices can be moved into a collision-free area in order to avoid collisions with the press slide or other components of the press arrangement.

Although the process described there is very suitable for avoiding collisions and corresponding successes can also be proven, it always requires a switching-off of the press arrangement. This approach has obvious disadvantages, such as loss of production or a possibly required new setting-up of the arrangement.

SUMMARY OF THE INVENTION

An object of the present invention is to provide a process for operating a press arrangement so that despite a possible voltage drop and even a brief complete power failure, the operation of the press arrangement can continue.

According to the invention, this object has been achieved by providing that in the event of a voltage drop at the input of the supply and feedback device, the current intensity is increased at the input of the supply and feedback device.

As a result, the power fed to the drive of the press slide remains the same. Thereby the process can be continued at a constant stroke rate. In this event, the supply and feedback device is overloaded to a certain degree, so that this process can be carried out to a certain degree of the voltage drop depending on the load capacity of the supply and feedback device.

An alternative approach for achieving this objective.

As a result of the reduction of the stroke rate of the press slide carried out there according to the invention in the event of a voltage drop at the input of the supply and feedback device, the press arrangement requires a lower power, whereby the current intensity is kept constant. As a result, voltage drop compensation takes place.

What the two above solutions above according to the invention, it is advantageously achieved that, in the event of a voltage drop to the complete failure of the voltage for a certain time, the operation of the press arrangement can be continued while the normal safety measures are maintained without having to stop production completely. A restarting of the press arrangement can thus, be prevented in each case according to the invention.

When the current intensity is increased at the input of the supply and feedback device, in an advantageous further development of the process according to the invention, if the maximal current intensity of the supply and feedback device is reached, the stroke rate of the press slide can also be reduced, whereby a flowing transition between or a combination of the two above-mentioned processes is obtained.

Other objects, advantages and novel features of the present invention will become apparent from the following detailed description of the invention when considered in conjunction with the accompanying drawings.

BRIEF DESCRIPTION OF THE DRAWINGS

The sole figure is a schematic diagram of an electric circuit for a press arrangement for implementing the process according to the invention.

DETAILED DESCRIPTION OF THE PREFERRED EMBODIMENTS

A supply and feedback device 2, in which the alternating voltage from the power supply is rectified, is connected to an A.C. power supply 1, for example, a 400 volt alternating-current power supply. For this purpose, the supply and feedback device 2 has an input 3 and an output 4 which can supply consuming devices with direct current.

An intermediate circuit 5 is connected to the output 4, to which consumer devices such as an inverter 6, several inverters 7*a*, 7*b* and 7*c* as well as a direct-voltage converter 8 are connected. This equipment is necessary for converting the direct voltage of, for example, 600 volt, existing in the intermediate circuit 5, into a voltage suitable for the equipment and devices described in the following.

Thus, a driving device 9 constructed as an electric motor is connected to the rectifier 6. The driving device 9 drives a flywheel 10 and thereby a conventional press slide, (not shown) of a press arrangement. The elements described above represent parts of this press arrangement which is known per se.

Three driving devices 11*a*, 11*b* and 11*c* are connected to the rectifiers 7*a*, 7*b* and 7*c* and are used for driving workpiece transport devices, such as a feeder, a sliding table or other handling devices for the press arrangement. The inverters 6 and 7*a*, 7*b* and 7*c* transform the direct voltage of, in the present case, 600 volt to an alternating voltage of, for example, 400 volt.

The direct-voltage converter 8 transforms the voltage of 600 volt from the intermediate circuit 5 to a direct voltage of, for example, 24 volt, in order to supply a PLC 12, a braking device 13 and various sensors 14 with direct current. The details of the operational method of the direct-voltage converter 8 are known per se and thus are also not important for the following discussion.

The supply and feedback device 2 can also be called a self-commutated pulsed feeding—feedback device and, in a self-commutated manner, regulates the intermediate circuit 5 of the press arrangement. In this manner, it is, among other things, also possible to feed electric energy from the flywheel 10 by way of the driving device 9, which will then be operated as a generator, into the intermediate circuit 5 or, by way of the supply and feedback device 2 back into the power supply.

In the normal case, a constant voltage of, for example, 400 volt, is constantly applied to the A.C. power supply 1 which, in an ideal case, results in a continuous operation of the press arrangement without disturbances. The supply and feedback device 2 supplies the intermediate circuit 5 from the A.C. power supply. The press drive 9 and at least one workpiece transport device are supplied from the intermediate current 5. The power, which can be taken from the intermediate circuit 5, is the result of the power which is fed from the power supply system into the intermediate circuit 5. This power is proportional to the voltage and the current at the input of the supply and feedback device 2.

If, however, the voltage drops at the A.C. power supply 1 and thus at the input 3 of the supply and feedback device 2, the current intensity is increased at the input 3 of the supply and feedback device 2. A constant power in the intermediate circuit 5 results, whereby the inverters 6, 7*a*, 7*b* and 7*c* as well as the direct-voltage converter 8 are also supplied with the normal power. In the final analysis, the driving device 9 for the press slide as well as the driving devices 11*a*, 11*b* and 11*c* for the workpiece transport devices are thereby supplied in the customary manner with electric power. Thereby during the operation of the press arrangement, the process can be carried out in the customary manner despite a possible voltage drop. This is possible until the maximally permissible current intensity of the supply and feedback device 2 has been reached.

When the maximally permissible current intensity of the supply and feedback device 2 has been reached, in the event of a voltage drop at the input 3 of the supply and feedback device 2, the stroke rate of the press slide will be reduced. A lower power demand of the press drive 6 results, whereby a lower power is taken from the intermediate circuit 5. Thus, despite a relatively long drop of the voltage, the operation of the press arrangement will be continued without the requirement of a switch-off of the press arrangement.

In the event of a voltage drop at the input 3 of the supply and feedback device 2, the current at the input 3 is correspondingly increased. Consequently, the power fed to the intermediate circuit 5 and thus to the press drive 9 and the workpiece transport device remains the same. The operation of the press arrangement can therefore be continued at a constant stroke rate. The current intensity can be increased until the maximally permissible current intensity of the supply and feedback device 2 has been reached. This is a function of the size of the selected supply and feedback device 2. The result is that the described process can be carried out to a certain degree of the voltage drop.

The transition from the above-described increase of the current intensity at the input 3 of the supply and feedback device 2 to the subsequently described reduction of the stroke rate of the press slide can take place continuously or, at a certain point, in a sudden manner.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Process for operating a press arrangement, comprising electromechanically driving a press slide and at least one workpiece transport device which are electrically supplied by a supply and feedback device having at least one input and at least one output, and, in the event of a voltage drop at the at least one input of the supply and feedback device, increasing the current intensity at the at least one input of the supply and feedback device.

2. Process for operating a press arrangement, comprising electromechanically driving a press slide and at least one workpiece transport device which are electrically supplied by a supply and feedback device having at least one input and at least one output, and, in the event of a voltage drop at the at least one input of the supply and feedback device, reducing a stroke rate of the press slide.

3. Process according to claim 1, further comprising reducing a stroke rate of the press slide when a maximally permissible current intensity of the supply and feedback device has been reached.

4. Process according to claim 1, further comprising feeding energy by a driving device into the intermediate circuit, via the press slide being connected with a flywheel, in the event of a voltage drop or power failure at the input of the supply and feedback device.

5. Process according to claim 1, further comprising supplying and feedback device with alternating current by an A.C. power supply, and converting alternating current to direct current by the supply and feedback device.

6. Process according to claim 5, further comprising connecting by an inverter the direct current provided by the supply and feedback device into an alternating current for at least one driving device of the press slide.

7. Process according to claim 5, further comprising connecting by an inverter the direct current provided by the supply and feedback device to an alternating current for at least one driving device of the at least one workpiece transport device.

8. Process according to claim 7, further comprising connecting by an inverter the direct current provided by the supply and feedback device into an alternating current for at least one driving device of the press slide.

9. Arrangement for carrying out the process according to claim 1, comprising a press slide, a workpiece transport device and a supply and feedback device having at least one input and at least one output.

10. Arrangement for carrying out the process according to claim 2, comprising a press slide, a workpiece transport device and a supply and feedback device having at least one input and at least one output.

* * * * *